US008776777B2

(12) United States Patent
Jin et al.

(10) Patent No.: US 8,776,777 B2
(45) Date of Patent: Jul. 15, 2014

(54) GAS HEATER WITH VISIBLE FLAME GUIDER

(76) Inventors: Weidong Jin, Shenzhen (CN); Weiqun Jin, Shenzhen (CN)

( * ) Notice: Subject to any disclaimer, the term of this patent is extended or adjusted under 35 U.S.C. 154(b) by 548 days.

(21) Appl. No.: 13/135,759

(22) Filed: Jul. 13, 2011

(65) Prior Publication Data

US 2013/0014748 A1 Jan. 17, 2013

(51) Int. Cl.
*F24B 1/181* (2006.01)
*F24B 9/04* (2006.01)

(52) U.S. Cl.
USPC ..... 126/91 A; 126/92 B; 126/519; 126/521; 431/125; 431/126; 431/350

(58) Field of Classification Search
CPC ..... F24B 1/183
USPC ..... 126/91 A, 92 B, 519, 521; 431/125, 126, 431/350
See application file for complete search history.

(56) References Cited

U.S. PATENT DOCUMENTS 517,361 A * 3/1894 Pomeroy ..... 362/171
1,489,886 A * 4/1924 Hart et al. ..... 454/39
3,614,914 A * 10/1971 Muller ..... 493/133
4,561,840 A * 12/1985 Nakamura et al. ..... 431/22
6,422,232 B1 * 7/2002 Ashton et al. ..... 126/92 B
7,086,855 B2 * 8/2006 Brice et al. ..... 431/328
7,175,424 B2 * 2/2007 Frink et al. ..... 431/126
7,682,232 B2 * 3/2010 Howard ..... 454/35
2005/0224067 A1 * 10/2005 Park, II ..... 126/50
2011/0067694 A1 * 3/2011 Bechtold ..... 126/92 B
2011/0076627 A1 * 3/2011 DiVentura ..... 431/12

FOREIGN PATENT DOCUMENTS

AU 2003203464 A1 * 10/2003 ..... F24C 15/06
DE 202011001786 U1 * 5/2011 ..... F24B 9/04
EP 1217302 A1 * 6/2002 ..... F24C 1/12

* cited by examiner

*Primary Examiner* — Steven B McAllister
*Assistant Examiner* — Nikhil Mashruwala
(74) *Attorney, Agent, or Firm* — Raymond Y. Chan; David and Raymond Patent Firm

(57) ABSTRACT

A gas heater includes a support unit, a burner unit, a venting unit and a frame guider. The burner unit includes an ignition unit, a hollow and transparent radiant unit defining a cavity in which the flame guider is positioned, a heat reflector and a burner top cover. The radiant unit comprises a bottom unit with inlet air passages through which an air flow into the radiant unit cavity is created. Then, the frame guider, which has a preset structure such as a spiral and a cone structure and a plurality of guider through-holes, is arranged for guiding and generating a flame pattern which is visible through the radiant unit. The venting unit, which is connected to the radiant unit in an air-tight manner, then provides an air exit. Accordingly, energy utilization is increased and visible flame pattern assemble to real flame can be seen.

12 Claims, 8 Drawing Sheets

GAS HEATER WITH VISIBLE FLAME GUIDER

BACKGROUND OF THE PRESENT INVENTION

1. Field of Invention

The present invention relates to a heating device, and more particularly to a flame guider for a heating device such that a flame pattern is formed in the heating device through which an evenly distributed and a natural looking flame is provided in an energy efficient manner, thereby an efficient heating effect is produced.

2. Description of Related Arts

Gas heater is commonly used for providing a heating effect to warm an area, which is especially useful in cold weather and is usually fueled with liquefied petroleum gas or natural gas. Conventional gas heater includes a burner, a gas supply inlet on the burner for providing a gas supply to the burner for generating a flame in the burner, and a radiant element for transmitting heat energy for providing a warming effect to the surrounding. Gas heater has the advantages of providing high level of heat in a short period of time while the cost is low and the operation is convenience, environmental friendly and safe. Therefore, the demand of gas heater in the market is growing rapidly and steadily over the years.

Energy saving is a recent concerns in view of environmental impact, energy crisis and the rising cost. Conventional gas heater fails to provide a large heating area through the burner for providing the warming effect to the surrounding. In particular, the heat transmission is not effective and much of the energy is lost and wasted.

Gas heater may become a household furniture or an appliance which is highly visible to users. The importance of aesthetic concern becomes more and more important. In electric heater, fake flame arrangement making use of additional light bulb or lighting device and reflector is used for providing a fake flame effect. However, it is not possible for the gas heater to include electric light bulb or LEDs for generating such fake flame effect. There still no solution for providing a fake flame effect in gas heater.

SUMMARY OF THE PRESENT INVENTION

The invention is advantageous in that it provides gas heater with flame guider so as to increase an energy efficiency while providing a preset flame pattern which resembles a real flame pattern.

Another advantage of the invention is to provide a gas heater which includes a radiant unit which is transparent and a flame guider positioned inside the radiant unit which generates a preset flame pattern which resembles a real pattern and is visible through the transparent radiant unit.

Another advantage of the invention is to provide a gas heater with a flame guider which provides a plurality of guider through-holes such that a preset flame pattern which resembles a real flame pattern is generated while improved heating effect is produced.

Additional advantages and features of the invention will become apparent from the description which follows, and may be realized by means of the instrumentalities and combinations particular point out in the appended claims.

According to the present invention, the foregoing and other objects and advantages are attained by a gas heater, comprising a support unit defining an upper end and a lower end; a burner unit supported by the support unit arranged for heat generation; a venting unit connected to the burner; and a frame guider supported through the support unit and received in the burner, wherein the burner unit comprises:

an ignition unit provided on the upper end of the support unit;

a transparent radiant unit having an elongated hollow structure defining a radiant unit cavity and a center axis arranged for providing a radiant heating effect, wherein a first end of the radiant unit is operatively communicatd with the ignition unit while connecting to the upper end of the support unit, wherein a second end of the radiant unit is connected to the venting unit in an air-tight manner;

a heat reflector coaxially aligned with and connected to the radiant unit through a second end of the radiant unit at the center axis in such a manner that the heat reflector is peripherally and transversely extended outward from the radiant unit at the second end without blocking a top opening of the radiant unit at the second end; and a burner top cover coaxially connected between the heat reflector and the venting unit in such a manner that the venting unit is opened to the radiant unit cavity through the top opening of the radiant unit without blockage of the burner top cover and the heat reflector is covered by the burner top cover, wherein the radiant unit further comprises a bottom unit at the first end of the radiant unit, wherein the bottom unit has a plurality of inlet air passage peripherally provided on the bottom unit such that air circulation is guided to flow from the inlet air passage into the radiant cavity and exit through the venting unit, wherein the frame guider is securely positioned inside the radiant unit cavity of the radiant unit, arranged for guiding and forming a flame pattern inside the radiant unit cavity which is visible through the transparent radiant unit, wherein the frame guider comprises a plurality of flame guider members through which a plurality of guider through-holes are provided thereon and a preset structure of the flame guider is defined; a longitudinal guider support longitudinally supporting the plurality of flame guider members to extended between the first end and the second end of the radiant unit inside the radiant unit cavity; and a bottom support anchoring the longitudinal guider support onto the upper end of the support unit and supporting the plurality of flame guider members, thereby the air circulation which is guided into the radiant cavity is further guided to flow through the flame guider before exiting through the venting unit such that the flame pattern is well-defined and formed through the flame guider and is visible through the transparent radiant unit.

Preferably, the plurality of flame guider members are integrally connected to form the preset structure, which is a spiral structure, such that the flame pattern resembles a real flame pattern and is visible through the radiant unit. Alternately, the plurality of flame guider members comprises a set of coaxially positioned ring-structured guider members which forms the preset structure, which is a cone-structured flame guider, such that the flame pattern resembles a real flame pattern and is visible through the radiant unit.

It is worth mentioning that the flame guider members are made of stainless steel materials, wherein the preset structure of the flame guider has a height which is approximately proportional to a power of the burner unit such that the height of the flame guider is approximately equal to a maximum height of a flame as produced by the burner unit, thereby maximizing a guiding effect of the flame guider while minimizing a material requirement for manufacturing the flame guider.

In particular, the ignition unit has an outlet which is coaxially aligned with the flame guider and the flame guider is firmly secured onto the upper end of the support unit so as to ensure a relative position between the flame guider and the outlet, thereby the flame pattern which is directly affected by the relative position between the flame guider and the outlet is free from distortion.

Preferably, the venting unit comprises a vent channel unit defining a vent opening, and a vent cover connected to the vent channel unit for selectively covering the vent opening in such a manner that the vent opening is capable of being completely covered and is capable of being open respectively, wherein the vent channel unit is connected to the second end of the radiant unit in an air-tight manner such that the second end is channeled through the vent channel unit to open through the vent opening, thereby ventilation at the second end is provided through the vent opening while a degree of opening of the vent opening is controllable through the vent cover.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
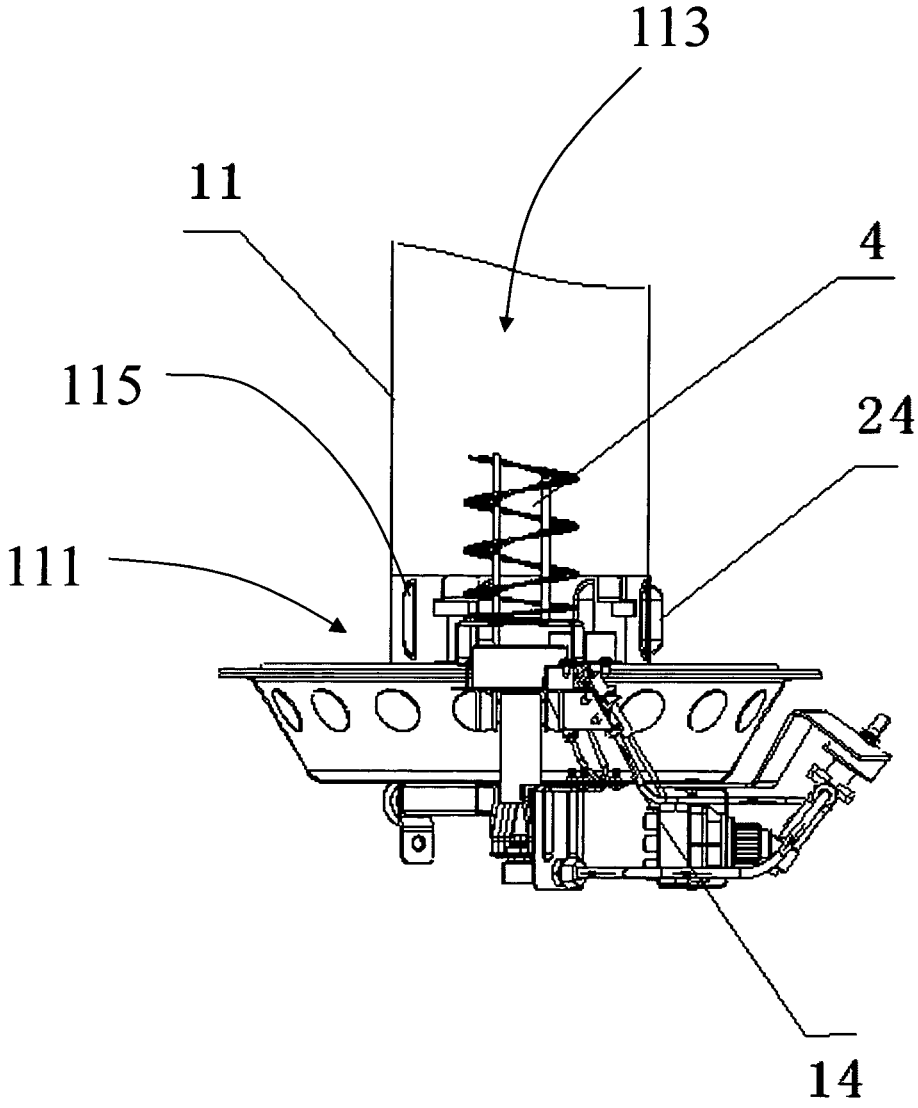
FIG. 1 is a partially exploded view of a heating device for showing a flame guider arrangement according to a preferred embodiment of the present invention.

Referring to FIGS. 1 to 7 of the drawings, a gas heater according to a preferred embodiment of the present invention includes a burner unit 1 for generating heat, a support unit 2 which supported the burner unit 1, a venting unit 5 connected to the burner unit 1 and communicated with the burner unit 1 for providing gas passage to the burner unit 1, and a flame guider 4 provided in the burner 1 for guiding and forming a flame pattern for burner unit 1.

The support unit 2 comprises a base body 21, a guider base support 22 on an upper end of the base body 21 which provides a supporting surface for positioning the to flame guider 4, and a base bottom 23 on a lower end of the base body 21 for providing a flat surface to secure into position on a surface, such as the ground or floor. Preferably, support unit 2 has sufficient weight to be securely placed and positioned on the floor. In other words, the gas heater can be embodied as a portable gas heater which is self supported through the support unit 2.

Figure 3:
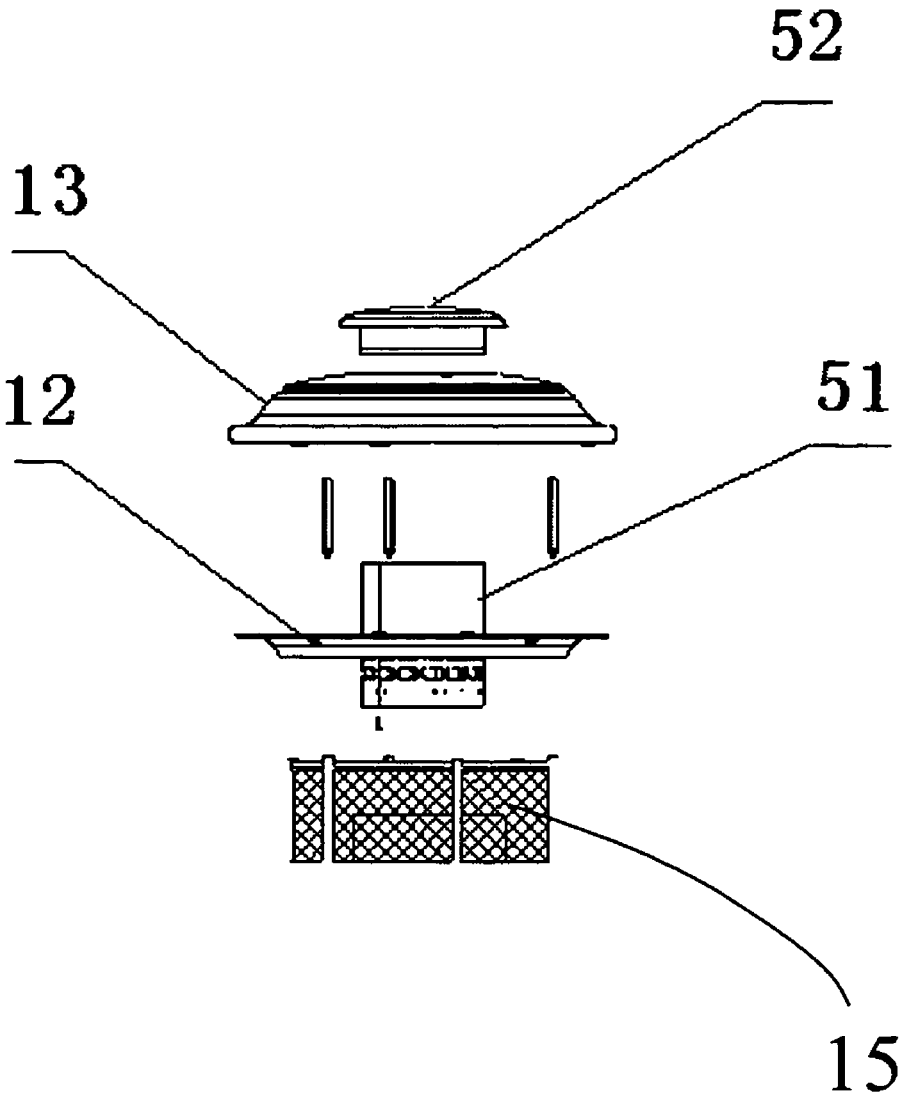
FIG. 3 illustrates an upper portion of the heating device according to the above preferred embodiment of the present invention.

Referring to FIGS. 1 and 3 of the drawings, the burner unit 1 comprises an ignition unit 14 provided towards the guider base support 22 on the upper end of the base body 21, a radiant unit 11 which has an elongated hollow structure defining a radiant unit cavity 113 at a center axis, having a first end 111 operatively communicated with the ignition unit 14 through connecting to the guider base support 22 and a second end 112 opposite to the first end 111, a heat reflector 12 coaxially aligned with the radiant unit 11 through connecting to the second end 112 of the radiant unit 11, a burner top cover 13 connected between the heat reflector 12 and the venting unit 5, and a protective guard unit 15 enclosing the radiant unit 11 at a distance in a peripheral manner.

It is worth mentioning that the heat reflector 12 is coaxially aligned with and connected to the radiant unit 11 through the second end 112 of the radiant unit 11 at the center axis in such a manner that the heat reflector 12 is peripherally and transversely extended outward from the radiant unit 11 at the second end 112 without blocking a top opening of the radiant unit 11 at the second end 112. Likewise, the burner top cover 13 is coaxially connected between the heat reflector 12 and the venting unit 5 in such a manner that the venting unit 5 is opened to the radiant unit cavity 113 through the top opening of the radiant unit 11 without blockage of the burner top cover 13 and the heat reflector 12 is covered by the burner top cover 13.

The protective guard unit is capable of protecting the radiant unit while providing high visibility for viewing the radiant unit. In particular, the radiant unit 11 is transparent and the protective guard unit 15 has a net structure. Accordingly, the radiant unit cavity 113 is visible from outside. In other words, any flame pattern inside the radiant unit cavity 113 is visible from outside.

The venting unit 5 comprises a vent channel unit 51 connecting and penetrating through a heat reflector opening 12 to connected to the second end 112 of the radiant unit 11 in an air-tight manner such that the second end 112 is channeled through the vent channel unit 51 and the vent channel unit 51 serves as the only passage at the second end 112 of the radiant unit 11; and a vent cover 52 connected through the burner top cover 13 to movably connected to the vent channel unit 51 in such a manner that the vent cover 52 covers the vent channel unit 51 in an air-tight manner at a first position and covers the vent channel unit 51 in a non-air-tight manner at a second position. In other words, dirt or unwanted particles are blocked from the vent cover 52 at the first position while gas passage is provided at the second position.

The radiant unit 11 further provides a bottom unit 115 provided at the first end 111 having a plurality of inlet air passages 24 towards the first end 111 of the radiant unit 11 for facilitating air circulation from the first end through the second end of the radiant unit 11 of the burner unit 1. Preferably, the bottom unit 115 of the radiant unit 11 has a two-layered structure having a bottom member for providing the inlet air passages 24 and a passage cover connected to the bottom member arranged for covering and exposing the inlet air passages 24 respectively. Preferably, the passage cover is moveably connected to the bottom member of the bottom unit 115 of the radiant unit 11 such that the degree of opening of the inlet air passages 24 is adjustable and controllable through the passage cover. Accordingly, a flow of air at the first end 111 of the radiant unit 11 is controllable and adjustable through the bottom unit 115.

It is worth mentioning that the plurality of inlet air passages 24 is peripherally provided at the first end 111 of the radiant unit 11. Accordingly, an evenly distributed air flow is created towards the radiant unit cavity 113 in a peripheral manner such that the flame generated through the burner 1 is guided through the air flow to move towards the center of the radiant unit through the flame guider 4 such that the flame is then guided through the flame guider 4 to produce the specific flame pattern.

Figure 2A:
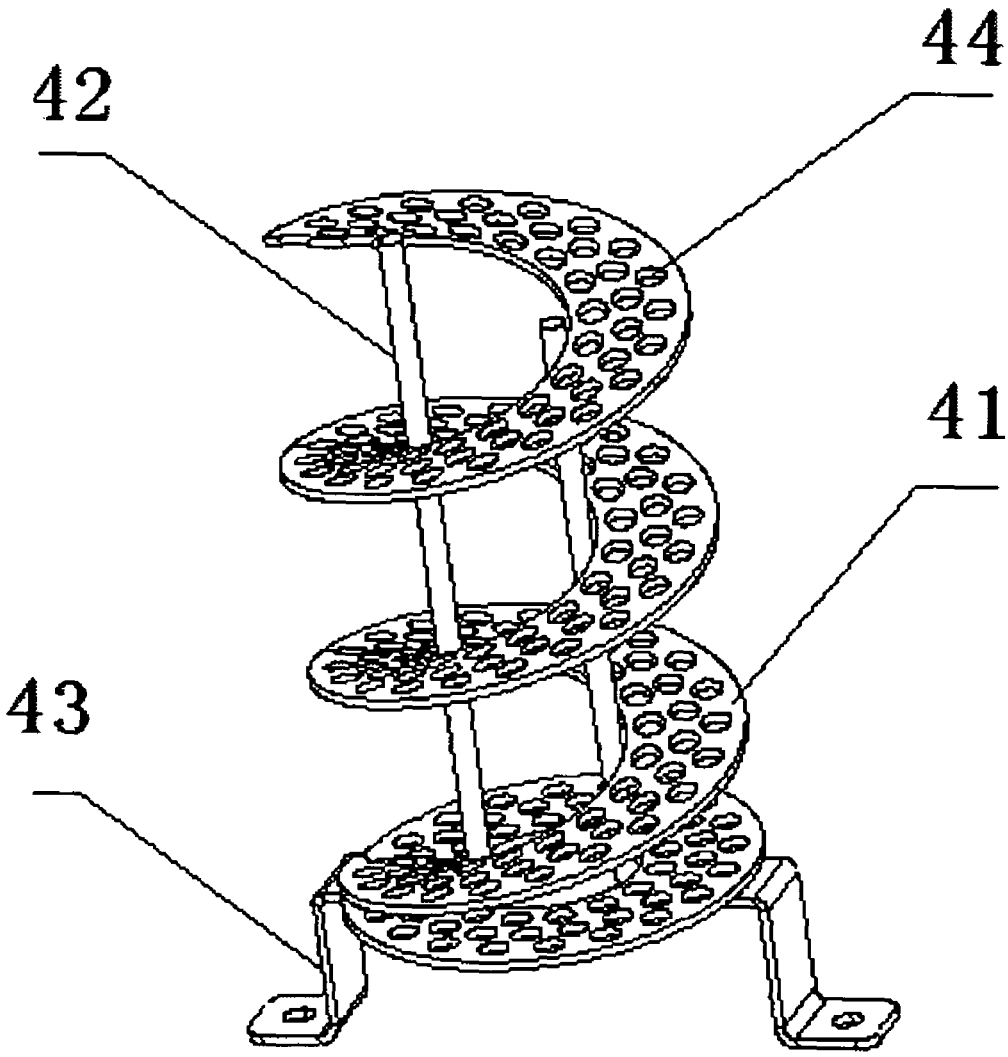
FIG. 2A is a flame guider arrangement of a heating device according to an illustration example of the above preferred embodiment of the present invention.
Figure 2B:
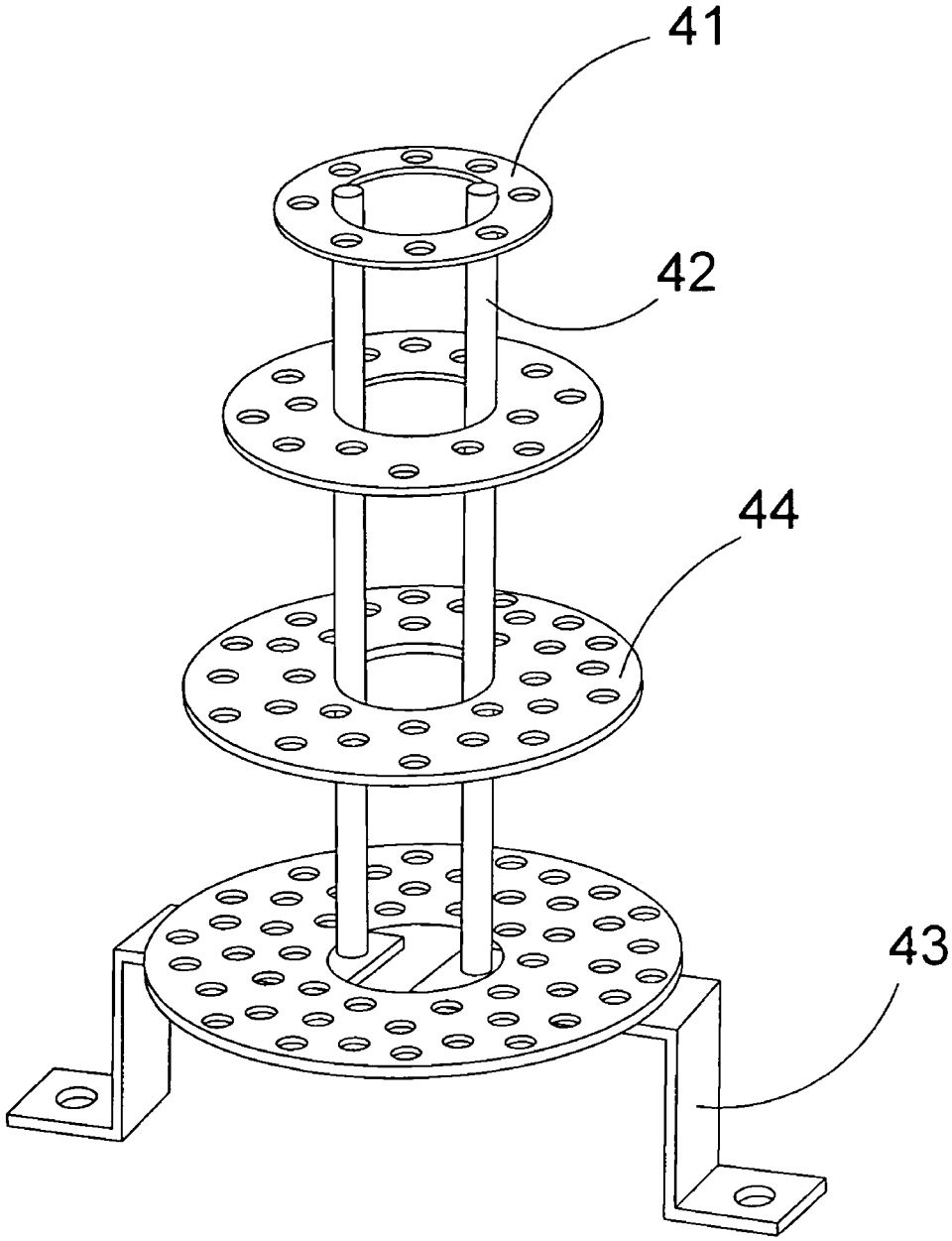
FIG. 2B is a flame guider arrangement of a heating device according to another illustration example of the above preferred embodiment of the present invention.

Referring to FIGS. 2A and 2B of the drawings, the flame guider 4 is positioned inside the radiant unit cavity 113 of the radiant unit, arranged for guiding and forming a flame pattern which is visible from outside through the transparent radiant unit 11 and the guard unit 15. Preferably, as shown in FIG. 2A, the flame guider 4 comprises a plurality of flame guider members 41 forming a spiral structure, a longitudinal guider support 42 longitudinally supporting the spiral structure of the flame guider members to extended between the first end 111 and the second end 112 of the radiant unit, a bottom support 43 securing the spiral structure onto the guider base support 22 of the support unit 2 through a bottom end of the spiral structure while connecting to the longitudinal guider support 42 serving as an anchor for the longitudinal guider support 42, and a plurality of guider through-holes 44 spacedly provided on each of the guider members 41.

It is worth mentioning that the flame guider 4 is coaxially aligned with an outlet of the ignition unit 14 and is securely connected onto the guider base support 22 so as to ensure the relative position between the flame guider 4 and the outlet of the ignition unit 14, thereby the flame which is generated through the ignition unit 14 is ensured to be positioned at the centre of the flame guider 4 and a flame pattern which is produced through the flame guider 4 is guided to be produced in an accurate manner.

Alternately, as shown in FIG. 2B, the plurality of flame guider members 41 comprises a set of discrete and concentrically positioned ring-structured guider members 41 which are parallel to each others, arranged for forming a cone-structured flame guider 4 in which a diameter of the flame guider members 41 which is closest to the ignition unit 14 is the largest amongst the plurality of ring-structured guider members 41.

Preferably, since the flame guider members 41 of the flame guider 4 are in direct contact with the flame generated through the ignition unit 14, stainless steel materials or other fire resistance materials are used for the flame guider members 41. Also, a height of the flame guider 4 is approximately equal to a maximum height of the flame as produced from the burner unit 1 so as to minimizing the material requirements of the guider 4 while maximizing the guiding effect of the guider 4.

Accordingly, the flame generated through the ignition unit 14 is guided through the flame guider 4 to produce a flame pattern, which is a circular flame pattern moving from the bottom to the top of the burner unit 1 inside the radiant unit 11 but visible from the outside. In other words, through the provision of flame guider 4, an increased area is utilized for providing the heating effect while a circular flame pattern which is visible from outside is guided to produce through the flame guider 4.

During operation, the inlet air flow is created through the inlet air passages on the bottom unit 115 of the radiant unit 11. The flame generated through the burner unit 1 is guided to burn in a peripheral manner to reach the flame guider 4, which is then guided through the guider through-holes 44 of the guider members 41 for providing the flame pattern such that the burning area is well-defined through the flame guider 4 and hence the heating effect is controllable and the efficiency for providing a warming effect is increased. On the other hand, the flame guider 4 has guided the flame to produce the flame pattern, which is basically a circular pattern, visible through the transparent radiant unit 11 and hence providing a visual effect to a user, which is enjoyable and delightful.

In other words, the flame guider 4 is not only responsible for generating the specific flame pattern which resembles a real flame pattern which is visible through the transparent radiant unit 11 and/or protective guard unit 15, but also capable of providing and defining the heating area inside the radiant unit 11, thereby enhancing the warming effect and efficiency in view of energy consumption.

Figure 4:
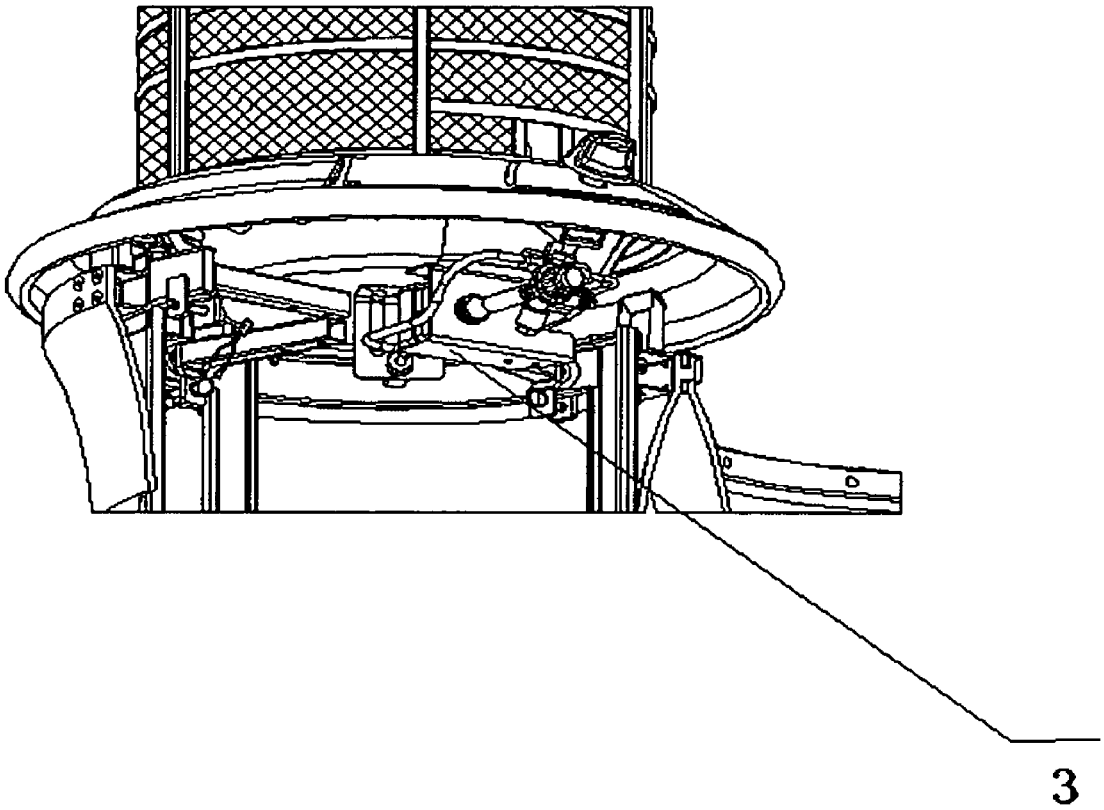
FIG. 4 illustrates a lifting arrangement of the heating device according to the above preferred embodiment of the present invention.
Figure 5:
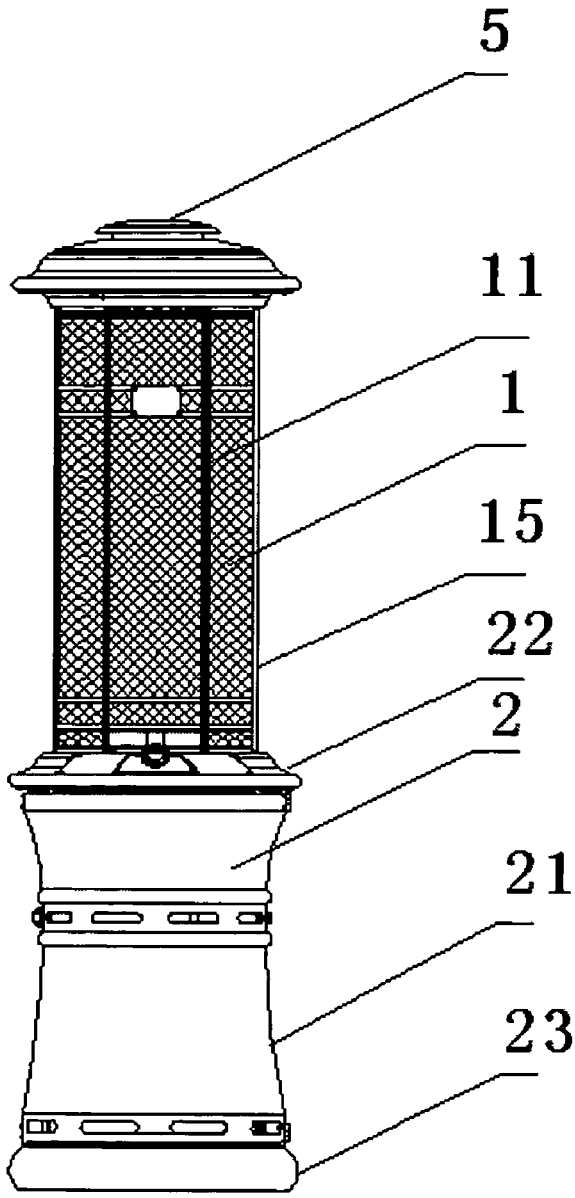
FIG. 5 illustrates a heating device under a first condition according to the above preferred embodiment of the present invention.
Figure 6:
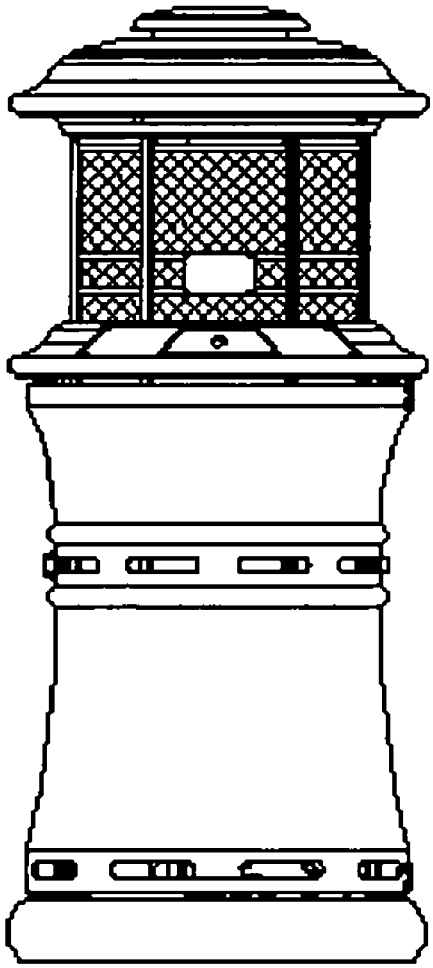
FIG. 6 illustrates a heating device under a second condition according to the above preferred embodiment of the present invention.

Preferably, as shown in FIGS. 4 to 6 of the drawings, the gas heater further comprises a lifting arrangement 3 provided on the support unit 2 through said upper end of the base body 21 which is arranged for communicating between the support unit 2 and the burner unit 1 in such a manner that at least a part of the burner unit 1 is retractable such that a height of the burner unit 1 is adjustable. In other words, as shown in FIG. 5, a compact size, which is a second condition, is defined when a part of the burner unit is retracted; and, as shown in FIG. 6, an expanded size, which is a first condition, is defined when the burner unit is expanded.

Figure 7:
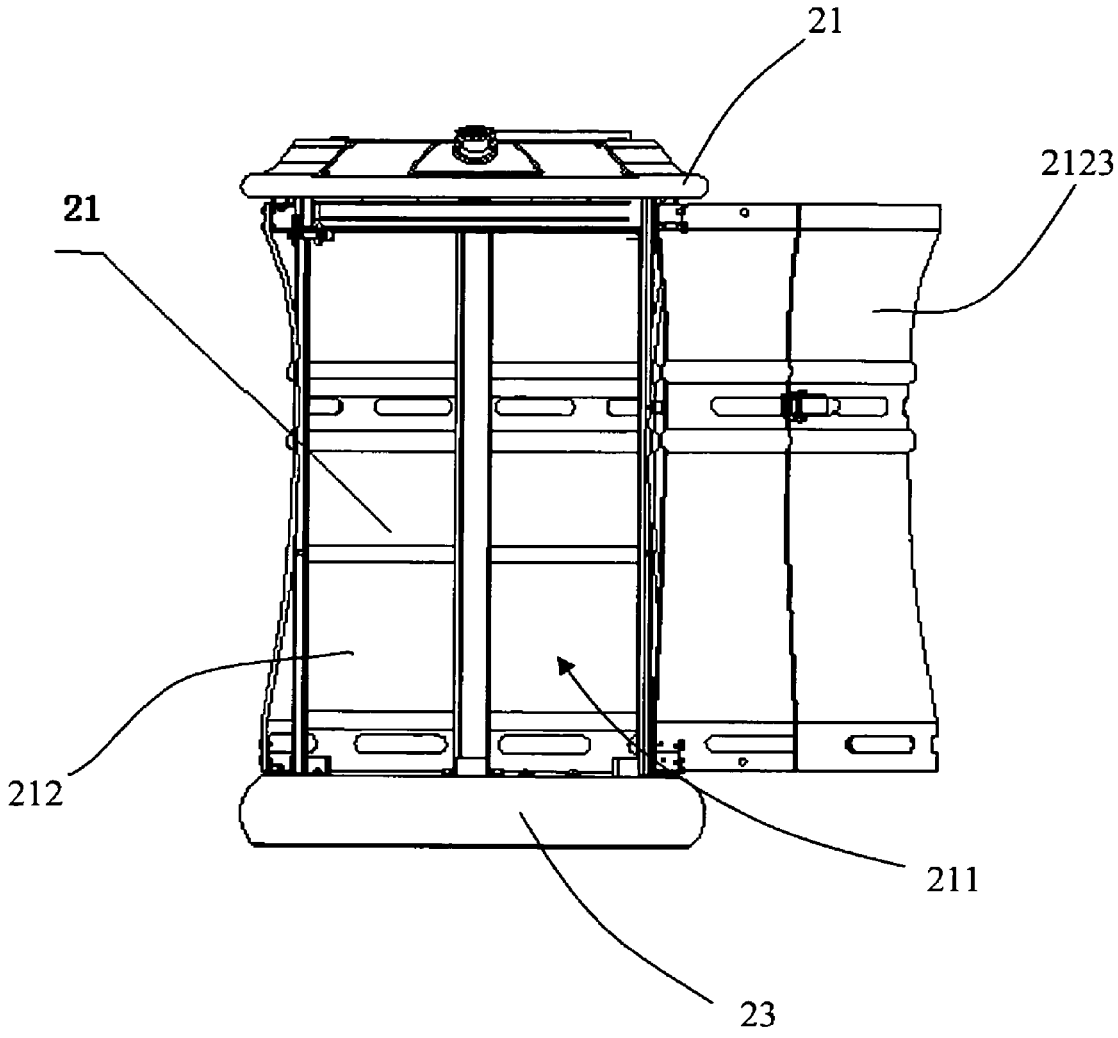
FIG. 7 illustrates a heating device casing for a heating device according to the above preferred embodiment of the present invention.

Preferably, as shown in FIG. 7 of the drawings, the base body 21 has a hollow body defining a storage cavity 211 therein and a plurality of base supporting frame 212 peripherally enclosed the storage cavity 211 for forming the storage cavity 211, and comprises a frame door 2123 moveably provided on the base body 21 to defining a close position at which said storage cavity 211 is completely enclosed through said base supporting frame 212 and said frame door 2123 and an open position at which said storage cavity 211 is open through said frame door 2123. The storage cavity 211 is arranged for placing a gas cylinder or bottle and a size of the storage cavity 211 is adjustable through the plurality of base supporting frame 212. Preferably, the size of the storage cavity 211 is sized to fit standard sized bottle or cylinder, such as 1 lb gas cylinder, 20 lb gas cylinder, or gas cylinder between 1 lb and 20 lbs. For example, during operation, after the gas heater is stationed at a particular location, the frame door 2123 can be opened and a gas bottle or cylinder can be installed and positioned inside the storage cavity 211 such that space requirement for the gas bottle or cylinder is reduced while movement of the gas heater as a whole unit is made possible. Accordingly, the provision of the storage cavity 211 provided additional advantages of space saving and convenience to a user. It is worth mentioning that the gas bottle or cylinder of different sizes can be used for the gas heater according to the preferred embodiment of the present invention.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A gas heater, comprising a support unit defining an upper end and a lower end; a burner unit supported by the support unit arranged for heat generation; a venting unit connected to said burner; and a flame guider supported by said support unit and received in said burner, wherein said burner unit comprises:

an ignition unit provided on the upper end of said support unit;

a transparent radiant unit having an elongated hollow structure defining a radiant unit cavity and a center axis arranged for providing a radiant heating effect, wherein a first end of said radiant unit is operatively communicatd with said ignition unit while connecting to said upper end of said support unit, wherein a second end of said radiant unit is connected to said venting unit in an air-tight manner;

a heat reflector coaxially aligned with and connected to said radiant unit through a second end of said radiant unit at said center axis in such a manner that said heat reflector is peripherally and transversely extended outward from said radiant unit at said second end without blocking a top opening of said radiant unit at said second end; and a burner top cover coaxially connected between said heat reflector and said venting unit in such a manner that said venting unit is opened to said radiant unit cavity by said top opening of said radiant unit without blockage of said burner top cover and said heat reflector is covered by said burner top cover, wherein said radiant unit further comprises a bottom unit at said first end of said radiant unit, wherein said bottom unit has a plurality of inlet air passage peripherally provided on said bottom unit such that air circulation is guided to flow from said inlet air passage into said radiant cavity and exit through said venting unit, wherein said flame guider is securely positioned inside said radiant unit cavity of said radiant unit, arranged for guiding and forming a flame pattern inside said radiant unit cavity which is visible through said transparent radiant unit, wherein said flame guider comprises a plurality of flame guider members through which a plurality of guider through-holes are provided thereon and a preset structure of said flame guider is defined; a longitudinal guider support longitudinally supporting said plurality of flame guider members to extended between said first end and said second end of said radiant unit inside said radiant unit cavity; and a bottom support anchoring said longitudinal guider support onto said upper end of said support unit and supporting said plurality of flame guider members, thereby the air circulation which is guided into said radiant cavity is further guided to flow through said flame guider before exiting through said venting unit such that the flame pattern is well-defined and formed through said flame guider and is visible through said transparent radiant unit, wherein said venting unit comprises a vent channel unit defining a vent opening, and a vent cover connected to said vent channel unit for selectively covering said vent opening in such a manner that said vent opening is capable of being completely covered and is capable of being open respectively, wherein said vent channel unit is connected to said second end of said 25 radiant unit in an air-tight manner such that said second end is channeled through said vent channel unit to open through said vent opening, thereby ventilation at said second end is provided through said vent opening while a degree of opening of said vent opening is controllable by said vent cover.

2. The gas heater, as recited in claim 1, wherein said plurality of flame guider members are integrally connected to form said preset structure, which is a spiral structure, such that the flame pattern resembles a real flame pattern and is visible through the radiant unit.

3. The gas heater, as recited in claim 2, wherein said flame guider members are made of stainless steel materials, wherein said preset structure of said flame guider has a height which is approximately proportional to a power of said burner unit such that said height of said flame guider is approximately equal to a maximum height of a flame as produced by said burner unit, thereby maximizing a guiding effect of said flame guider while minimizing a material requirement for manufacturing said flame guider.

4. The gas heater, as recited in claim 3, wherein said ignition unit has an outlet which is coaxially aligned with said flame guider and said flame guider is firmly secured onto said upper end of said support unit so as to ensure a relative position between said flame guider and said outlet, thereby the flame pattern which is directly affected by the relative position between said flame guider and said outlet is free from distortion.

5. The gas heater, as recited in claim 4, wherein said support unit comprises a base body, a guider base support at said upper end of said support unit on which said radiant unit and said flame guider are secured into position, and a base bottom at said lower end of said support unit which provides a flat bottom surface of sufficient weight such that said gas heater is a self-standing and supporting structure.

6. The gas heater, as recited in claim 5, wherein said base body of said support unit has a hollow body defining a storage cavity therein and a plurality of base supporting frame peripherally aligned for forming said storage cavity, and comprises a frame door moveably provided on said base body to defining a close position at which said storage cavity is completely enclosed through said base supporting frame and said frame door, and an open position at which said storage cavity is open through said frame door, thereby a gas bottle is capable of being placed inside said storage cavity and connecting to said burner unit for providing gas supply.

7. The gas heater, as recited in claim 6, wherein said burner unit further comprises a protective guard unit which has a net structured surface enclosing said radiant unit 11 at a distance in a peripheral manner, thereby protecting said radiant unit while providing high visibility for viewing said radiant unit.

8. The gas heater, as recited in claim 7, wherein said bottom unit of said radiant unit has a two-layered construction having a bottom member for providing said inlet air passages and a passage cover moveably connected with said bottom member for controlling a degree of opening of said plurality of inlet air passages, thereby a flow of air at said first end of said radiant unit is controllable and adjustable through said bottom unit.

9. The gas heater, as recited in claim 8, wherein said venting unit comprises a vent channel unit defining a vent opening, and a vent cover connected to said vent channel unit for selectively covering said vent opening in such a manner that said vent opening is capable of being completely covered and is capable of being open respectively, wherein said vent channel unit is connected to said second end of said radiant unit in an air-tight manner such that said second end is channeled through said vent channel unit to open through said vent opening, thereby ventilation at said second end is provided through said vent opening while a degree of opening of said vent opening is controllable through said vent cover.

10. The gas heater, as recited in claim 2, wherein said burner unit further comprises a protective guard unit which has a net structured surface enclosing said radiant unit 11 at a distance in a peripheral manner, thereby protecting said radiant unit while providing high visibility for viewing said radiant unit.

11. The gas heater, as recited in claim 10, wherein said bottom unit of said radiant unit has a two-layered construction having a bottom member for providing said inlet air passages and a passage cover moveably connected with said bottom member for controlling a degree of opening of said plurality of inlet air passages, thereby a flow of air at said first end of said radiant unit is controllable and adjustable through said bottom unit.

12. The gas heater, as recited in claim 1, wherein said burner unit further comprises a protective guard unit which has a net structured surface enclosing said radiant unit 11 at a distance in a peripheral manner, thereby protecting said radiant unit while providing high visibility for viewing said radiant unit.

* * * * *